US009782687B2

(12) United States Patent
Bagley

(10) Patent No.: US 9,782,687 B2
(45) Date of Patent: Oct. 10, 2017

(54) MAGNETIC CONSTRUCTION BLOCK TOY SET

(71) Applicant: Jim Matthews Bagley, West Valley City, UT (US)

(72) Inventor: Jim Matthews Bagley, West Valley City, UT (US)

(73) Assignee: Gracewood Management, Inc., West Valley City, UT (US)

( * ) Notice: Subject to any disclaimer, the term of this patent is extended or adjusted under 35 U.S.C. 154(b) by 0 days.

(21) Appl. No.: 14/993,628

(22) Filed: Jan. 12, 2016

(65) Prior Publication Data

US 2017/0197154 A1 Jul. 13, 2017

(51) Int. Cl.
*A63H 33/04* (2006.01)

(52) U.S. Cl.
CPC ..... *A63H 33/046* (2013.01)

(58) Field of Classification Search
CPC ..... A63H 33/04; A63H 33/046; A63H 33/06; A63H 33/067
See application file for complete search history.

(56) References Cited

U.S. PATENT DOCUMENTS 1,236,234 A 4/1925 Oscar
2,795,893 A 6/1957 Vayo
2,885,822 A 5/1959 Onanian
2,939,243 A 6/1960 Duggar
3,077,696 A 2/1963 Barnett et al.
3,090,155 A 5/1963 Gordon
3,095,668 A 7/1963 Dorsett
3,184,882 A * 5/1965 Vega ..... A63H 33/046 446/92
3,254,440 A 6/1966 Duggar
4,114,307 A * 9/1978 Liebeskind ..... A63H 33/062 428/53
4,334,871 A 6/1982 Roane
4,513,970 A * 4/1985 Opresco ..... A63F 9/34 273/153 S
5,009,625 A * 4/1991 Longuet-Higgins . A63H 33/046 434/211
5,021,021 A 6/1991 Ballard
5,098,328 A * 3/1992 Beerens ..... A63H 33/086 446/125
5,168,677 A 12/1992 Pronsato et al.
5,347,253 A * 9/1994 Ogikubo ..... A63F 9/12 273/239

(Continued)

*Primary Examiner* — Gene Kim
*Assistant Examiner* — Alyssa Hylinski
(74) *Attorney, Agent, or Firm* — J. David Nelson

(57) ABSTRACT

A magnetic block set of magnetically connectable magnetic block units. The magnetic block units have a block body with a plurality of geometrically or ornamentally shaped connection faces, a plurality of magnetic element chambers, a plurality of magnetic elements rotatably retained in respective magnetic element chambers, and a plurality of connection face receivers for each connection face, the connection face receivers being uniformly positioned and oriented radially from a magnetic element chamber center, uniformly dimensioned and shaped radially with respect to the magnetic element chamber center, and uniformly distributed tangentially with respect to the magnetic element chamber center of the respective magnetic element chamber.

22 Claims, 12 Drawing Sheets

(56) References Cited

U.S. PATENT DOCUMENTS 5,380,233 A * 1/1995 Numoto ..... A63H 3/46 403/59
D359,315 S * 6/1995 Tacey ..... D21/499
5,746,638 A * 5/1998 Shiraishi ..... A63H 33/046 446/131
5,957,453 A * 9/1999 Binkley ..... A63F 9/0811 273/153 S
6,431,936 B1 8/2002 Kiribuchi
6,566,992 B1 5/2003 Vicentelli
6,626,727 B2 9/2003 Balanchi
6,702,641 B2 3/2004 Oakley
6,749,480 B1 6/2004 Hunts
6,846,216 B1 1/2005 Balanchi
7,038,567 B2 5/2006 Vicentelli
7,066,788 B2 6/2006 Rubin et al.
7,154,363 B2 12/2006 Hunts
7,255,624 B2 8/2007 Daftari
7,261,506 B2 * 8/2007 Smolarek ..... F16B 39/282 411/114
7,273,404 B2 9/2007 Kowalski et al.
7,320,633 B2 * 1/2008 Park ..... A63H 33/046 446/131
7,322,873 B2 1/2008 Rosen et al.
7,413,493 B2 8/2008 Toht et al.
7,507,136 B2 3/2009 Patton
7,520,793 B2 * 4/2009 Pillai ..... A63H 3/16 446/92
7,559,821 B2 7/2009 Pacheco
7,833,078 B2 11/2010 Kretzschmar
7,955,156 B2 6/2011 Toht et al.
7,988,518 B2 8/2011 Kim et al.
8,070,550 B2 * 12/2011 Song ..... A63H 33/046 446/129
8,128,452 B2 3/2012 Kim et al.
8,157,608 B1 4/2012 Stapleton
8,292,687 B2 10/2012 Tremblay et al.
8,303,366 B2 11/2012 Tremblay et al.
8,475,255 B2 7/2013 Wolf et al.
8,491,312 B2 7/2013 Rudisill et al.
8,529,311 B2 9/2013 Tremblay et al.
8,850,683 B2 10/2014 Haughey et al.
9,457,288 B2 * 10/2016 Choi ..... A63H 33/084
2010/0120322 A1 5/2010 Vicentelli
2012/0164913 A1 * 6/2012 Pomeroy ..... A63H 33/046 446/137
2012/0270465 A1 * 10/2012 Park ..... A63H 33/046 446/129
2012/0309259 A1 * 12/2012 Mak ..... A63H 33/046 446/92
2014/0227935 A1 8/2014 Yoon
2014/0227939 A1 * 8/2014 Kim ..... A63H 33/046 446/124
2014/0302741 A1 * 10/2014 Whittaker ..... A63H 33/046 446/92
2016/0160904 A1 * 6/2016 Lee ..... F16B 39/24 411/332

* cited by examiner

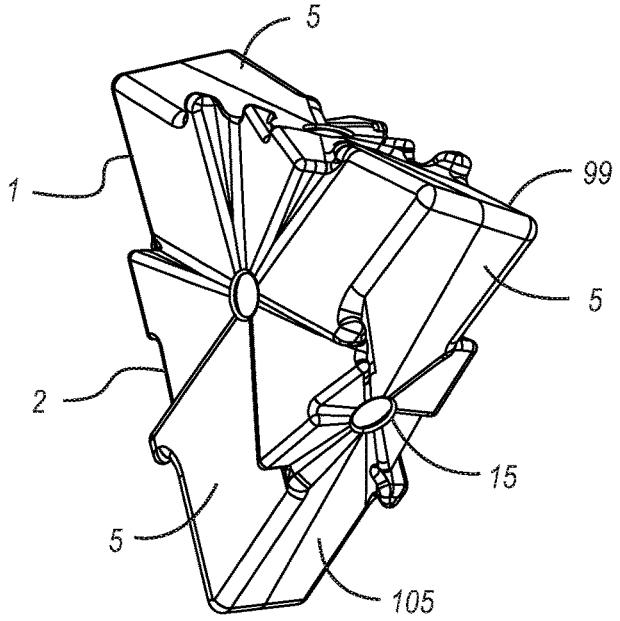
Fig. 16
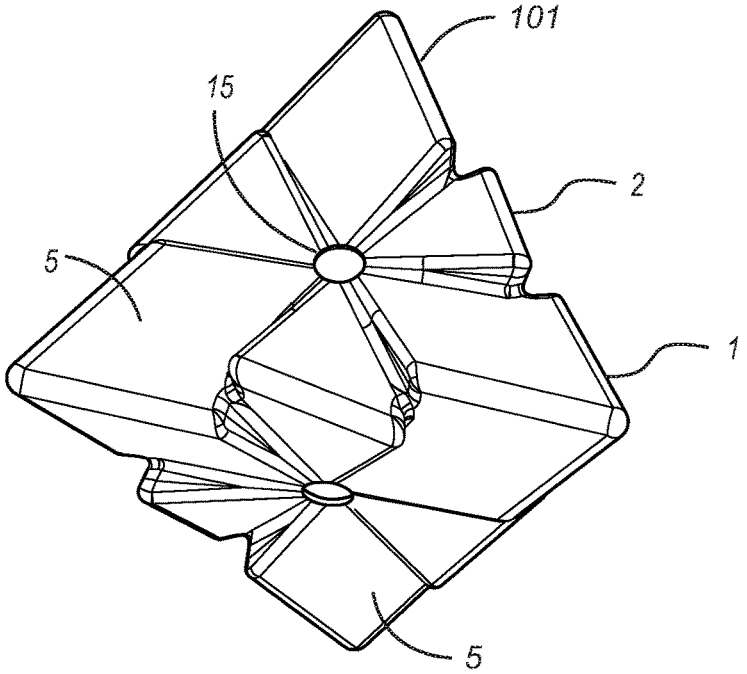
Fig, 17

MAGNETIC CONSTRUCTION BLOCK TOY SET

BACKGROUND OF INVENTION

This invention refers to building block toys for children, and in particular to magnetically connectable toy block units.

Children have played with and learned from their play with building blocks for hundreds of years. Many types of blocks, from rudimentary stackable wood blocks to interlocking or otherwise engaging block systems that have been developed in more modern times, are well known. Magnetic elements to assist in the secure engagement of block elements have been deployed for a number of inventions for which patents have been issued by the US Patent and Trademark Office and other international patent authorities.

Prior blocks and block sets, including magnetically enhanced blocks and blocks sets, that have attempted to provide more complex stimulation and promote more long term interest by the children, have also met with varying degrees of success.

It is an object of the present invention to provide a set of magnetically connectable magnetic block units with varying three dimensional shapes and a capability for a variety of interconnection options.

It is a further objective of the present invention to provide a set of magnetically connectable magnetic block units with varying three dimensional shapes and a capability for a variety of interconnection options with magnetic elements which assist in the implementation of the variety of interconnection options.

It is a further objective of the present invention to provide a set of magnetically connectable magnetic block units with varying three dimensional shapes and a capability for a variety of interconnection options with magnetic elements and surface features that facilitate the selection and implementation of the various block interconnection options.

SUMMARY OF THE INVENTION

A preferred embodiment of a magnetic block unit of the magnetic block set of the present invention is a cubular magnetic block unit. For this embodiment of the magnetic block unit, each of the connection faces is square shaped. Each connection face has a plurality of connection face receivers, each of which incorporates a connection face protrusion and a connection face recess connected by a receiver surface. For this embodiment of the magnetic block unit, each connection face also has a magnetic element chamber opening. The connection face receivers are of uniform shape and dimension, and for a preferred triangular shaped embodiment of the connection face receivers, may extend from the magnetic element chamber opening to a connection face edge. The connection face receivers are uniformly positioned and oriented radially from the magnetic element chamber center, and are uniformly distributed tangentially around the magnetic element chamber center.

For a preferred embodiment of the magnetic block unit, the receiver surface is generally triangular shaped. An alternative preferred embodiment has circular shaped receiver surfaces. While a generally triangular shaped receiver surface is preferred, and a circular receiver surface is alternatively preferred, it will be obvious to a person skilled in the art, in view of the disclosures of the drawings and description presented in this specification, that other shapes may be used for the receiver surface other than the generally triangular or circular shapes. The shape of the receiver surface may be essentially any geometric shape such as a triangle, a circle, square, rectangle, parallelogram, or oval. However the inventor has noted that a generally triangular shape is a preferred shape due to ease of alignment, mating, and rotational positioning of the magnetic block units with respect to each other.

The magnetic block preferably may have a hollow core with a solid shell structure. An alternative embodiment may have a solid core.

The magnetic block unit may have a magnetic element assembly which may include a spherical magnetic element retained within a spherical magnetic element chamber positioned proximal to the connection surface of each of the connection faces. The magnetic element chamber has a magnetic element chamber opening in each of the connection surfaces. The magnetic element chamber opening has a chamber opening diameter which is less than the magnetic element diameter so as to prevent the escape of the magnetic element from the magnetic element chamber through the magnetic element chamber opening. The magnetic element chamber diameter is greater than the magnetic element diameter, providing a magnetic element clearance which allows a magnetic element rotation of the magnetic element in the magnetic element chamber so as to provide for the element polarity of the magnetic element to be aligned to the element polarity of the magnetic element of another magnetic block unit as they are being connected.

A spherical shape for the magnetic element and the magnetic element chamber is preferred in order to enhance the free rotation of the magnetic element in the magnetic element chamber. However, any shape may be used for the magnetic element or the magnetic element chamber that provide for the free rotation of the magnetic element in the magnetic element chamber. Because the respective magnetic element proximal to each respective connection face of each respective magnetic block unit is preferably free to rotate in the respective magnetic element chamber, the magnetic elements of any two connection faces positioned for connection, will rotate, regardless of their prior non-engaged polarity position, so as provide for an alignment of the respective polarities. The magnetic elements may align north pole to south pole, or may align south pole to north pole.

For an alternative of the magnetic element assembly, the magnetic element chamber has no magnetic element chamber opening. The advantage of this embodiment is that the magnetic element chambers are sealed against the intrusion of a foreign substance, such as dust, grit and liquids of varying kinds to which a magnetic block set of the present invention which may be subjected by the intended users, mainly children, who may be playing with the magnetic block set of the present invention inside or outside and under varying conditions as far as exposure to possible intruding solids or liquids. It may have a disadvantage of slightly weakening the attraction between the magnetic elements of connecting magnetic block units, due to the magnetic element separation at the connection faces. It might also lessen the visual appeal of the magnetic block units to the children who are the intended users of the magnetic block set, since they will not be able to see the magnetic elements.

The uniform dimensioning, positioning, orientation, and distribution of the connection face receivers, as well as the uniform receiver surface slant angle, for each of the receiver surfaces of each of the magnetic block units of the magnetic block set of the present invention provides for the mating and interlocking of the respective connections faces of connected magnetic block units. When the connection surface of a connection face of one magnetic block unit is mated with and connected to the connection surface of a connection face of another magnetic block unit, because each connecting face will be mating with a reflective structure, i.e. a mirrored structure of the other, with the magnetic element chamber centers and magnetic elements aligned, the connection face receivers will mate with respective receiver surfaces being in contact, thereby securing the two magnetic block units together. However, in order for the magnetic block units to be stackable with sides and corners aligned, not only must the connection face receivers be uniformly dimensioned (except as truncated at the connection face edges), positioned, oriented, and distributed, and have a uniform receiver surface slant angle, the connection face receivers must be uniformly positioned and distributed within each face quadrant with each quadrant boundary line being aligned with a receiver radial center line. This provides for the connection surface of a connection face of one magnetic block unit to be mated with and connected to the connection surface of a connection face of another magnetic block unit with sides and corners aligned, because each connecting face will be mating with a reflective structure, i.e. a mirrored structure of the other. Even if the connection surface and the connection face receiver for a connection face is truncated, the connection face will still readily connect with and mate with the connection face of other magnetic block units of the magnetic block set of the present invention having connection faces of varying geometric shapes.

The structure of the connection face receivers of this embodiment of the magnetic block unit allows the rotational positioning of one magnetic block unit with respect to the other magnetic block unit that it is connected to, providing for a variety of interconnection configurations between connected magnetic block units. While the connected magnetic block units may be rotated with respect to each other in the bias direction, generally without separating the magnetic block units magnetically, the magnetic block units will have to be separated in order to rotate in the counter bias direction. The blocks can be easily rotated with respect to each other in the bias direction but such rotation and repositioning will be resisted in the counter bias direction, requiring separation of the magnetic block units.

Similarly, a large variety of additional shapes other than the shapes commonly referred to as geometric shapes may be used for the connection faces. These may include a circular or generally circular shape, an oval shape, a flower petal shape, or virtually any ornamental shape that provides for the uniform dimensioning, positioning, orientation, and distribution of the connection face receivers, as well as the uniform receiver surface slant angle, for each of the connection faces. This may provide for the mating of such connection faces with connection faces of other block units having the same or different shapes. This may also provide for the mating with a block unit of a base of a figurine or other objects of play having a circular or other preferred shape of connection face.

BRIEF DESCRIPTION OF THE DRAWINGS

FIG. 16 is a perspective view of a triangular solid magnetic block unit of the present invention, the invention having two equilateral triangle shaped connection faces and three rectangular shaped connection faces.

FIG. 17 is a perspective view of a triangular composite magnetic block unit.

DETAILED DESCRIPTION OF PREFERRED EMBODIMENTS

Figure 1:
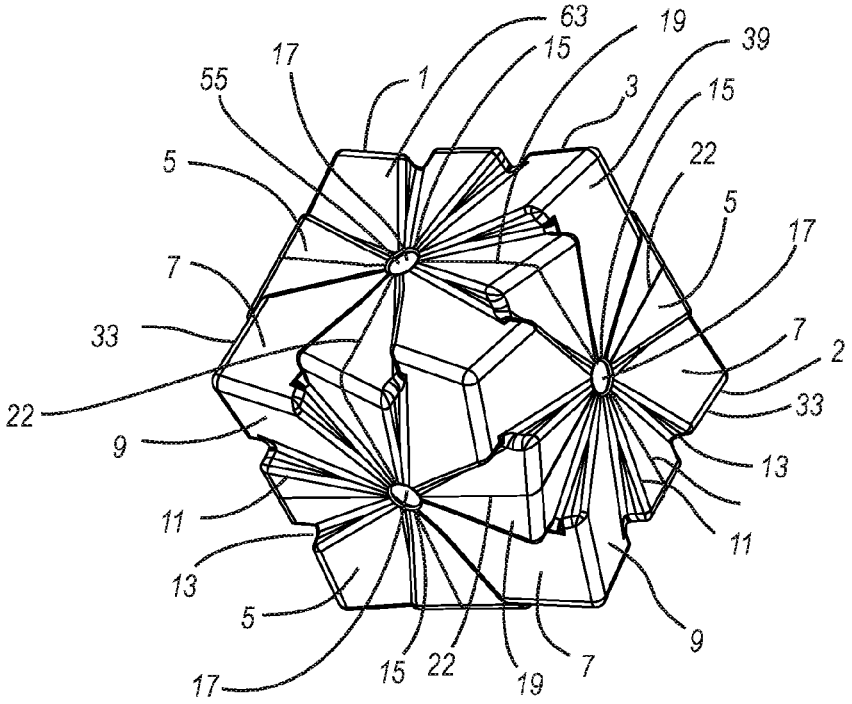
FIG. 1 is a perspective view of a magnetic block unit of a preferred embodiment of the magnetic block set of the present invention, the magnetic block unit being in a cubular shape and having a preferred surface feature configuration.

Referring first to FIG. 1, a perspective view of a preferred embodiment of a magnetic block unit 1 of the magnetic block set of the present invention, which, for the embodiment shown, is a cubular magnetic block unit 3 embodiment of the magnetic block unit 1 of the present invention having a block body 2 which is cubular shaped. For this embodiment of the magnetic block unit 1, each of the connection faces 5 are square shaped connection faces 7. For the preferred embodiment shown, each connection face 5 has connection face surface features 9 including of a plurality of connection face receivers 63, each of which are comprised of a connection face protrusion 11, a connection face recess 13, and a receiver surface 19 which connects the connection face protrusion 11 to the connection face recess 13. The connection face surface features 9 also include a magnetic element chamber opening 15.

The connection face protrusions 11 are of uniform shape and dimension, and, for the embodiment shown in FIG. 1, extend from the magnetic element chamber opening 15 to the connection face edge 33, are uniformly positioned and oriented radially from the magnetic element chamber center 17, and are uniformly distributed tangentially around the magnetic element chamber center 17. Likewise, the connection face recesses 13 are of uniform shape and dimension as they extend from the magnetic element chamber opening 15 to the connection face edge 33, are uniformly positioned and oriented radially from the magnetic element chamber center 17, and are uniformly distributed tangentially around the magnetic element chamber center 17. Each of the connection face protrusions 11 and the connection face recesses 13 are connected by a receiver surface 19, which is preferably planar between the connection face protrusions 11 and the connection face recesses 13. For the embodiment of the magnetic block unit 1 shown in FIG. 1, the receiver surface 19 is generally triangular shaped.

Figure 2:
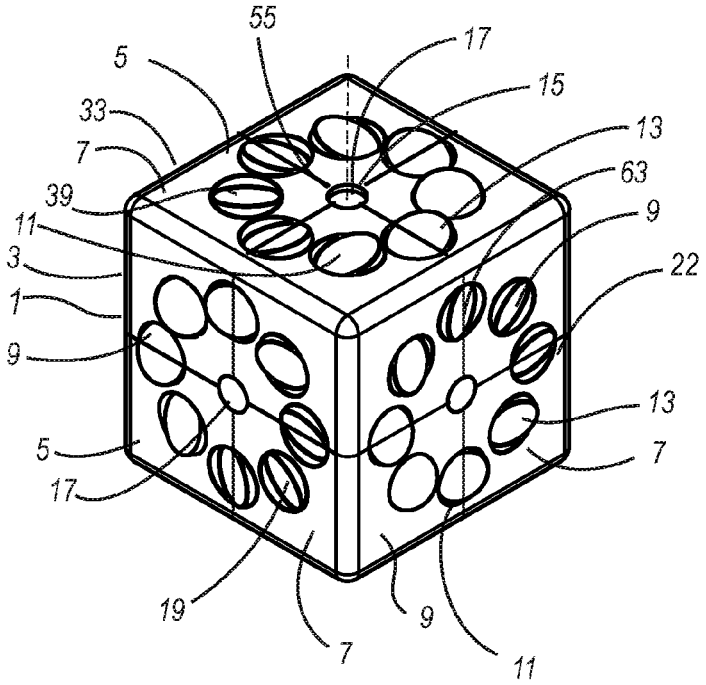
FIG. 2 is a perspective view of an alternative magnetic block unit of a preferred embodiment of the magnetic block set of the present invention, the magnetic block unit being in a cubular shape and having a preferred alternative surface feature configuration.

Referring now to FIG. 2 an alternative preferred embodiment of the cubular magnetic block unit 3 having connection faces 5 with connection face surface features 9 including circular shaped receiver surfaces 19. As shown for the embodiment of FIG. 1, the connection face receivers 63 are uniformly positioned and uniformly oriented radially from the magnetic element chamber center 17 and are uniformly distributed tangentially around the magnetic element chamber center 17.

As will be further discussed hereafter, while the generally triangular shaped receiver surface 19 for the embodiment shown in FIG. 1 is preferred, and the circular receiver surface 19 of the embodiment shown in FIG. 2 is an alternative preferred embodiment, it will be obvious to a person skilled in the art, in view of the disclosures of the drawings and description presented in this specification, that other shapes, including particularly other geometric shapes, may be used for the receiver surface 19 other than the generally triangular or circular shapes of FIG. 1 and FIG. 2 respectively.

Figure 3:
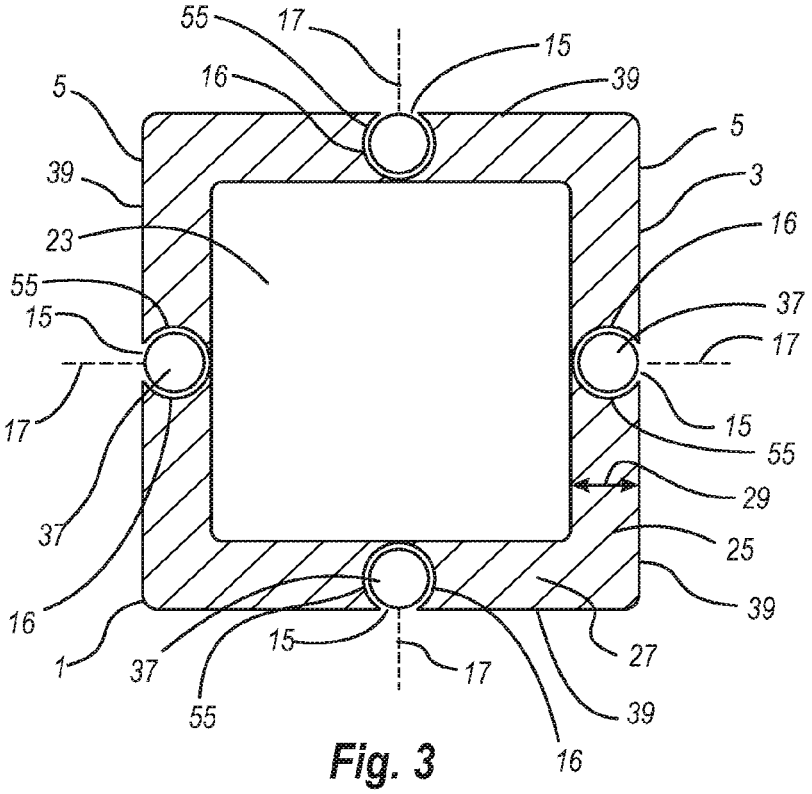
FIG. 3 is a cross section of a cubular magnetic block unit of the present invention with a hollow core, the cross section taken at the magnetic element position.
Figure 4:
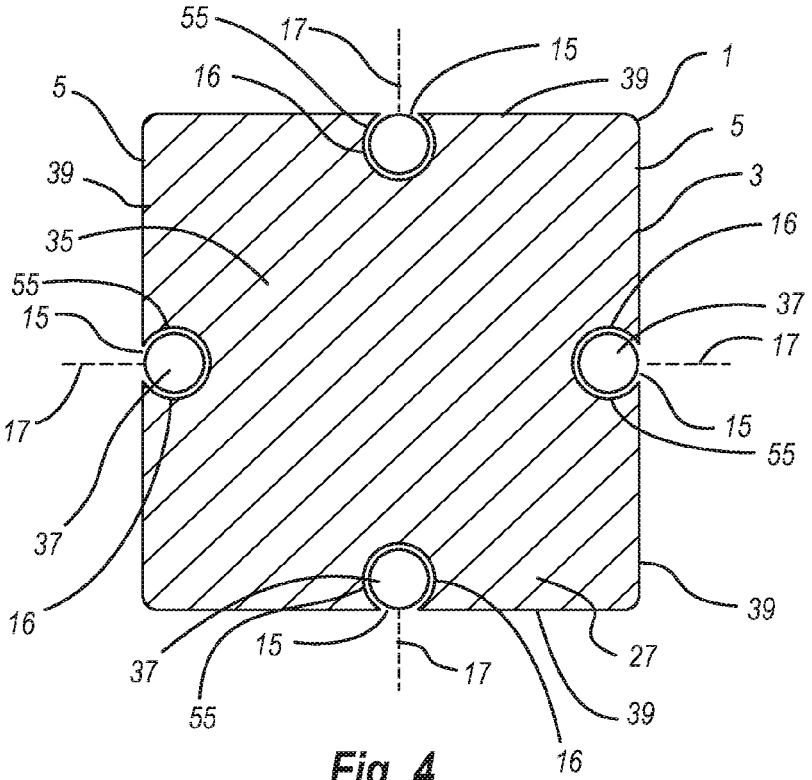
FIG. 4 is a cross section of an alternative preferred embodiment of a cubular magnetic block unit of the present invention with a solid core, the cross section taken at the magnetic element position.

Referring now to FIG. 3, a cross section of the cubular magnetic block unit 3 of FIG. 1, is shown. This cross section may be taken along a fabrication seam 22 such as that illustrated in FIG. 1, where halves or portions of the magnetic block unit may be assembled together according to manufacturing methods known to persons of skill in the art. For the embodiment shown in FIG. 3, the cubular magnetic block unit 3 has a hollow core 23, with a solid shell structure 25 including a unit shell 27. For the embodiment shown, the unit shell 27 is shown with a uniform shell thickness 29. However, a shell thickness variation may be incorporated to facilitate manufacturing, to reduce weight, to reduce cost, to increase strength or to accomplish other objectives that will be known to persons of skill in the art in view of the disclosures of the drawings and this specification. Although it is anticipated by the inventor of the present invention that the preferred method of manufacturing of the magnetic block set of the present invention will be to extrude each of the magnetic block units 1 from plastic, other materials and manufacturing procedures may be used for the production of the magnetic block units 1 of the present invention. Referring also to FIG. 4, an alternative embodiment of the cubular magnetic block unit 3 is shown having a solid core 35. For this solid core alternative, alternative material and methods of manufacture will be obvious to persons of skill in the art in view of the disclosures of the drawings and description stated herein.

Figure 5:
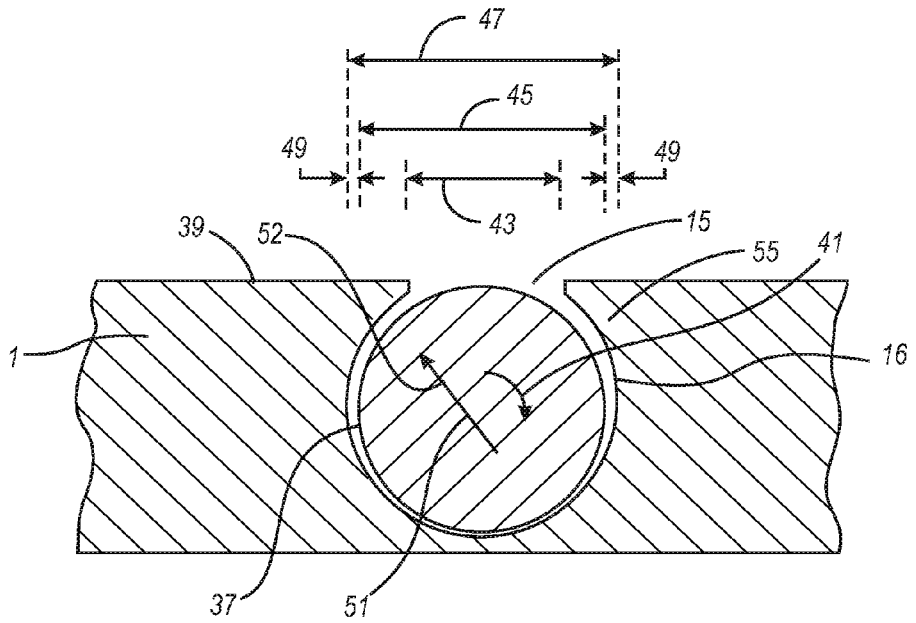
FIG. 5 is a cross section detail of a preferred embodiment of a magnetic element assembly, including a preferred embodiment of a magnetic element chamber and a magnetic element of the magnetic element assembly, the magnetic element chamber having a chamber surface opening.

Referring further to FIG. 3 and FIG. 4, for the embodiments shown, a magnetic element assembly 55 which may include a spherical magnetic element 37 retained within a spherical magnetic element chamber 16 positioned proximal to the connection surface 39 of each of the connection faces 5. Referring also to FIG. 5, a cross section detail of the magnetic element assembly 55 of FIGS. 1-4 is shown. For this preferred embodiment, the magnetic element 37 and the magnetic element chamber 16 may be approximately or generally spherical and not necessarily precisely spherical. For the purposes of this specification, including the claims, the term "spherical" shall be defined to include approximately or generally spherical.

Figure 6:
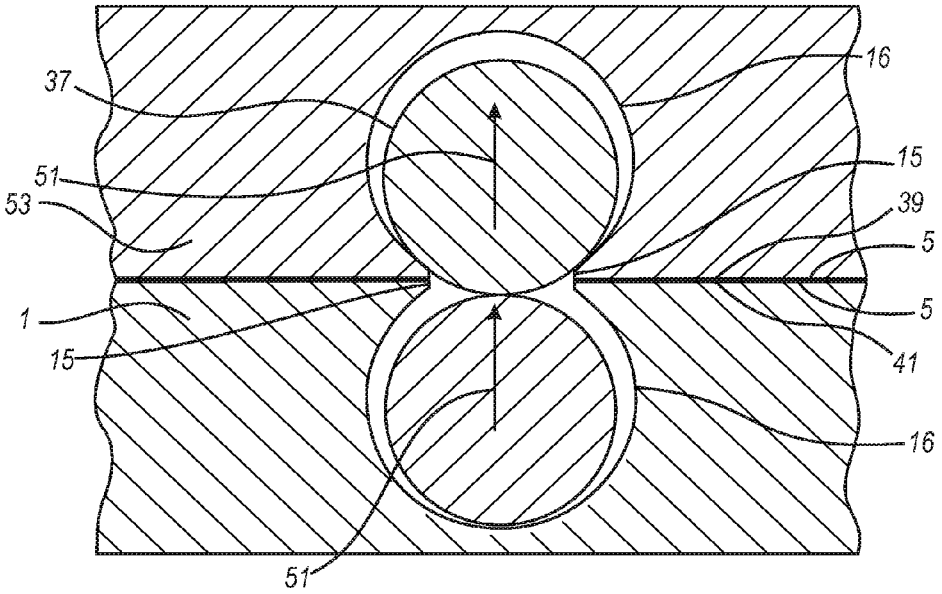
FIG. 6 is a cross section detail of a preferred embodiment of magnetic element assemblies of two connected magnetic block units, including a preferred embodiment of a magnetic element chamber and a magnetic element of the respective magnetic element assemblies, showing the positioning and polarity alignment of the two magnetic elements, each of the magnetic element chambers having a chamber surface opening.

For the embodiment shown in FIG. 3 and FIG. 4, the magnetic element chamber 16 has a magnetic element chamber opening 15 in each of the connection surfaces 39. Referring also to FIG. 5, the magnetic element chamber opening 15 has a chamber opening diameter 43 which is less than the magnetic element diameter 45 so as to prevent the escape of the magnetic element from the magnetic element chamber 16 through the magnetic element chamber opening 15. The magnetic element chamber diameter 47 is greater than the magnetic element diameter 45, providing a magnetic element clearance 49 which allows a magnetic element rotation 41 of the magnetic element 37 in the magnetic element chamber 16 so as to provide for the element polarity 51 of the magnetic element 37 to be aligned to the element polarity 51 of the magnetic element 37 of another magnetic block unit 53 as it is being connected to the magnetic block unit 1 as shown in FIG. 6. The polarity 51 of the magnetic elements 37 shown in FIGS. 5-8 is illustrated with the arrow pointing in the direction of the north pole of the magnetic field.

Referring to FIG. 6, the magnetic elements 37 must be free to rotate within the respective magnetic element chambers 16 to ensure that when the connection faces 5 of respective magnetic block units 1 and 53 are placed in the vicinity of each other with the intent to connect the connection faces 5, the respective magnetic elements 37 will rotate in their respective magnetic element chambers 16 so as to align the polarity 51 of the magnetic elements 37, thereby providing for an attraction between the respective magnetic elements 37 and thereby securing the magnetic block units 1 and 53 together with the connection faces 5 in contact. A spherical shape for the magnetic element 37 and the magnetic element chamber 16 is preferred in order to enhance the free rotation of the magnetic element 37 in the magnetic element chamber 16. However, any shape may be used for the magnetic element 37 or the magnetic element chamber 16 that provide for the free rotation of the magnetic element 37 in the magnetic element chamber 16. Because the respective magnetic element 37 proximal to each respective connection face 5 of each respective magnetic block unit 1 is preferably free to rotate 41 in the respective magnetic element chamber 16 as shown in FIG. 5, the magnetic elements 37 of any two connection faces positioned for connection as shown in FIG. 6, and also in FIG. 18, will rotate, regardless of their prior non-engaged polarity position 52 as shown in FIG. 5, so as provide for an alignment of the respective polarities 51 as shown in FIG. 6. The magnetic elements 37 may align north pole to south pole, as shown in FIG. 6, or may align south pole to north pole, i.e. with the polarities 51 of magnetic block units 1 and 53 reversed from that shown in FIG. 6.

Figure 7:
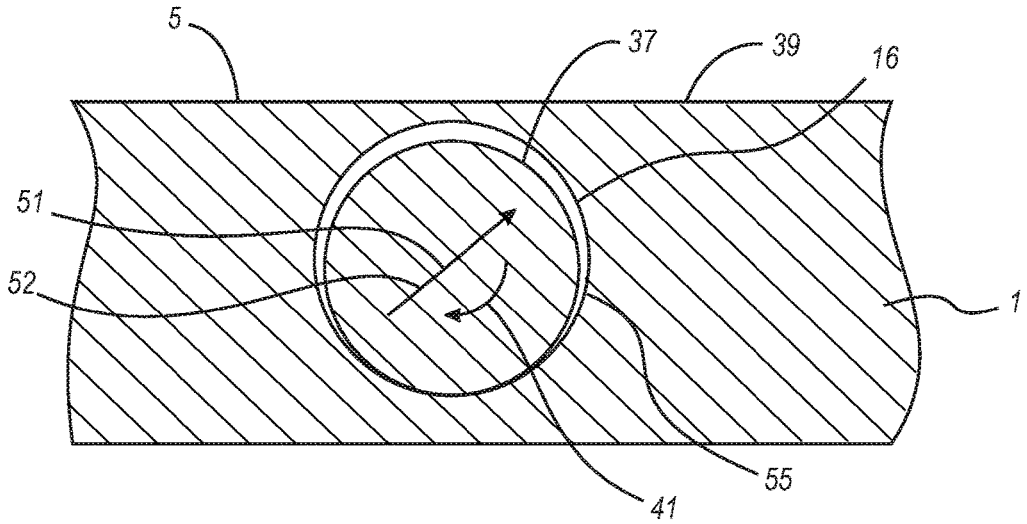
FIG. 7 is a cross section detail of an alternative preferred embodiment of a magnetic element assembly, including a preferred embodiment of a magnetic element chamber and a magnetic element of the magnetic element assembly, the respective magnetic element chambers being sealed.
Figure 8:
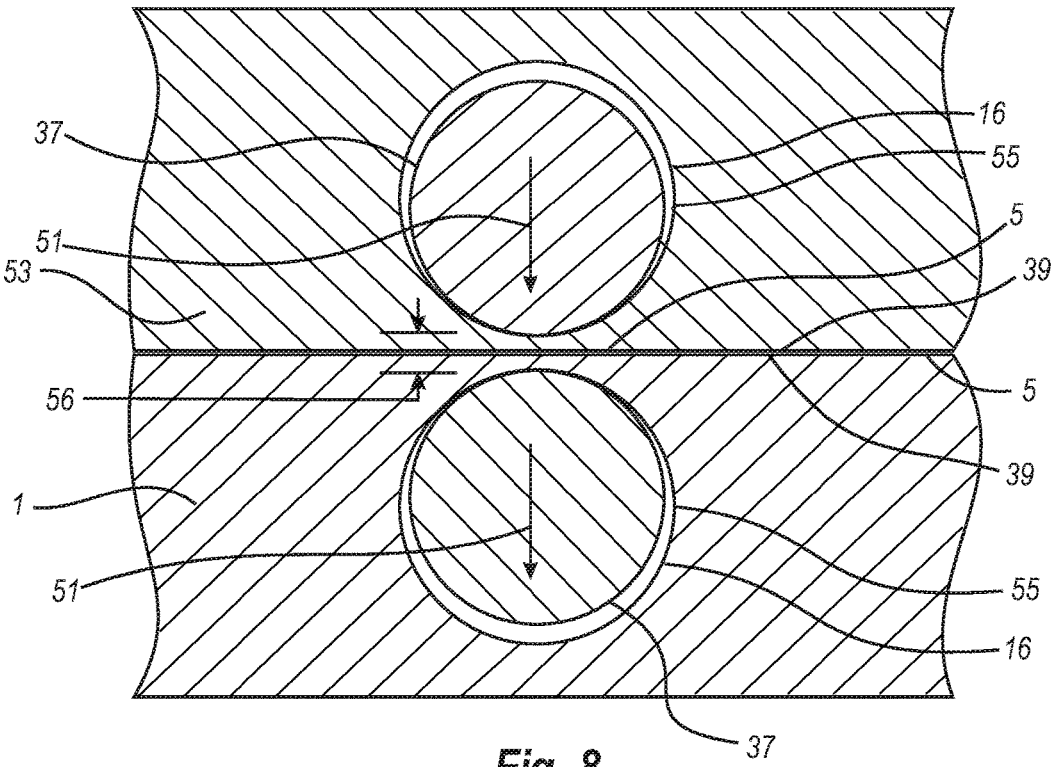
FIG. 8 is a cross section detail of an alternative preferred embodiment of magnetic element assemblies of two connected magnetic block units, including an alternative preferred embodiment of a magnetic element chamber and a magnetic element of the respective magnetic element assemblies, showing the positioning and polarity alignment of the two magnetic elements, each of the magnetic element chambers, each of the magnetic element chambers being sealed.

Referring now to FIG. 7 an alternative of the magnetic element assembly 55 is shown. For this embodiment the magnetic element chamber 16 has no magnetic element chamber opening 15 as shown in FIGS. 1-5 and shown in detail in FIG. 5. The advantage of this embodiment is that the magnetic element chambers 16 are sealed against the intrusion of a foreign substance, such as dust, grit and liquids of varying kinds to which a magnetic block set of the present invention which may be subjected by the intended users, mainly children, who may be playing with the magnetic block set of the present invention inside or outside and under varying conditions as far as exposure to possible intruding solids or liquids. Thus the embodiment shown in FIG. 7 provides for the magnetic element chamber 16 to be sealed against the intrusion of outside substances. It may have a disadvantage of slightly weakening the attraction between the magnetic elements 37 of connecting magnetic block units, such as that shown for magnetic block units 1 and 53 as shown in FIG. 8, due to the magnetic element separation 56 at the connection faces 5. It might also lessen the visual appeal of the magnetic block units 1 to the children who are the intended users of the magnetic block set, since they will not be able to see the magnetic elements 37.

Figure 9:
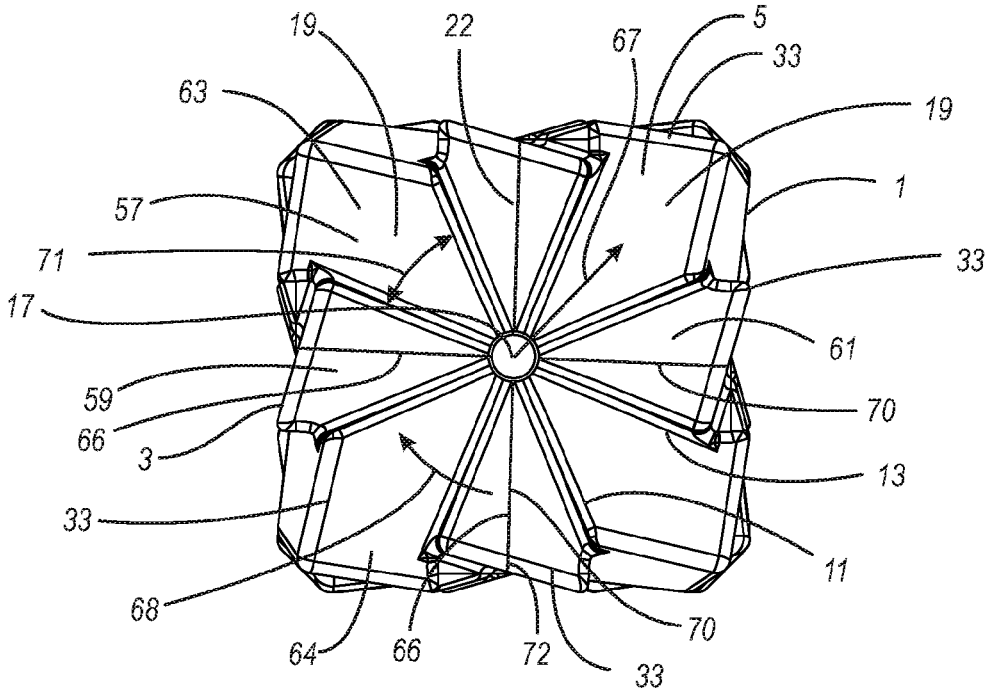
FIG. 9 is a plan view of a square shaped connection face of a preferred embodiment of a magnetic block unit of the present invention, a preferred surface feature configuration having a generally triangular shaped receiver surface, the connection face having a magnetic element chamber surface opening.

Referring now to FIG. 9 a plan view of a connection face 5 of a preferred embodiment of a magnetic block unit 1 having a generally square face 57 with a surface feature configuration 59 incorporating a plurality of generally triangular receiver surfaces 19. Each connection face protrusion 11 and the corresponding connection face recess 13 are interconnected by a receiver surface 19. The connection face protrusion 11, the connection face recess 13, and the receiver surface 19 which connect them, together form a connection face receiver 63. The receiver surface 19 is preferably planar between the connection face protrusion 11 and the connection face recess 13 which the receiver surface 19 connects. Each of the connection face receivers 63, as well as the connection face protrusion 11, the connection face recess 13 and the receiver surface 19 which may comprise the connection face receiver 63, are uniformly positioned and oriented radially 67 from the magnetic element chamber center 17. Further, each of the connection face receivers 63, as well as the connection face protrusion 11, the connection face recess 13 and the receiver surface 19, are uniformly dimensioned except for the variations in the extent of any truncation of these features at the connection face edge 33. The number of connection face receivers 63 is preferably uniform for each connection face 5 of each magnetic block unit 1 of a magnetic block set of the present invention and the connection face receivers 63 are preferably uniformly distributed tangentially 68 around the magnetic element chamber center 17 for each connection face 5 of each magnetic block unit 1.

Figure 11:
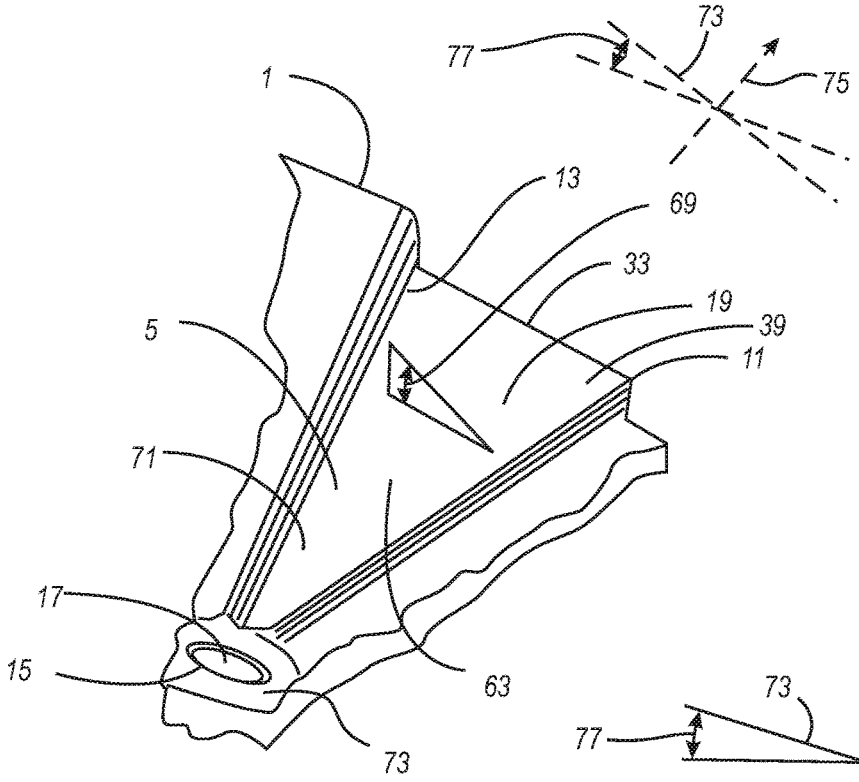
FIG. 11 is a perspective detail of the generally triangular shaped receiver surface of a preferred surface feature configuration having a magnetic element chamber surface opening.

Referring also to FIG. 11, a perspective detail of a connection face protrusion 11, connection face recess 13, and a receiver surface 19 of a preferred embodiment of a connection face receiver 63 is shown. In addition to being uniformly dimensioned (except as truncated), positioned, and oriented with respect to the magnetic element chamber center 17, the tangential orientation of the receiver surface 19 with respect to the overall plane of the connection face 5, namely the receiver surface slant angle 69, is preferably uniform for each of the connection face receivers 63.

Referring also again to FIG. 9, the receiver angular displacement 71 will be uniform, and will be equal to 360 degrees divided by the total number of connection face receivers 63. Referring again to FIG. 11, the angular displacement between the connection face surface 73 of the connection face 5 and each receiver surface 19 about a connection face radial axis 75 extending from the magnetic element chamber center 17 will be a uniform receiver face angle 77.

Figure 18:
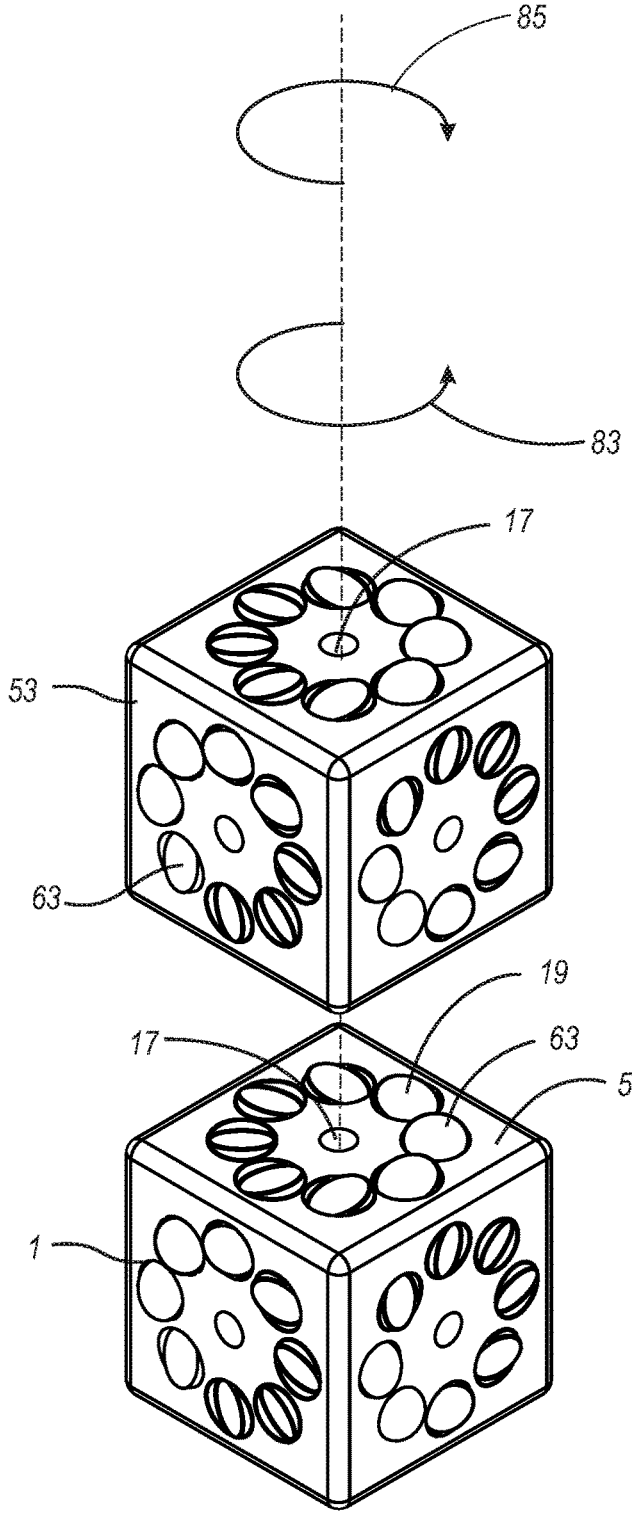
FIG. 18 is a perspective exploded view detail of two connected and aligned magnetic block units.

The uniform dimensioning, positioning, orientation, and distribution of the connection face receivers 63, as well as the uniform receiver surface slant angle 69, for each of the receiver surfaces 19 of each of the magnetic block units 1 of the magnetic block set of the present invention provides for the mating and interlocking of the respective connections faces 5 of connected magnetic block units 1 of the present invention. When the connection surface 39 of a connection face 5 of one magnetic block unit 1 is mated with and connected to the connection surface 39 of a connection face 5 of another magnetic block unit 1, because each connecting face 5 will be mating with a reflective structure, i.e. a mirrored structure of the other, with the magnetic element chamber centers 17 and magnetic elements 37 aligned, the connection face receivers 63 will mate with respective receiver surfaces 19 being in contact, thereby securing the two magnetic block units 1 together as shown in FIG. 6 and FIG. 8. However, in order for the magnetic block units 1 and 53 to be stackable with sides and corners aligned as shown in FIG. 18, not only must the connection face receivers 63 be uniformly dimensioned (except for truncation at the connection face edges 33 for the embodiment shown in FIG. 1), positioned, oriented, and distributed, and have a uniform receiver surface slant angle 69, the connection face receivers 63 must be uniformly positioned and distributed within each face quadrant 64 with each quadrant boundary line 66 being aligned with a receiver radial center line 70 as shown in FIG. 9 and FIG. 10.

Figure 10:
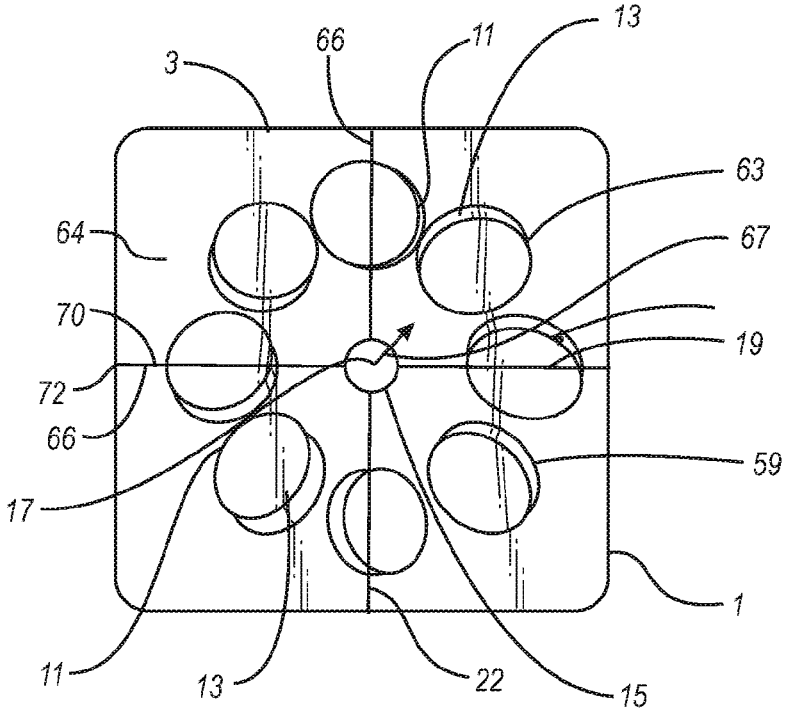
FIG. 10 is a plan view of a square shaped connection face of a preferred embodiment of a magnetic block unit of the present invention, a preferred surface feature configuration having a generally circular shaped receiver surface, the connection face having a magnetic element chamber surface opening.

For a cubical magnetic block unit 3, each quadrant boundary line 66 extends from the magnetic element chamber center 17 of the connection face 5 to the edge center 72 of a connection face edge 33 as shown in FIG. 9 and FIG. 10. This provides for the connection surface 39 of a connection face 5 of one magnetic block unit 1 to be mated with and connected to the connection surface 39 of a connection face 5 of another magnetic block unit 53 with sides and corners aligned, because each connecting face 5 will be mating with a reflective structure, i.e. a mirrored structure of the other. This provides for the magnetic element chamber centers 17 and the magnetic elements 37 to be aligned, and the respective connection face receivers 63 of magnetic block unit 1 and other magnetic block unit 53 to mate with respective receiver surfaces 19 being in contact, securing the two magnetic block units 1 and 53 together with sides and corners aligned as shown in FIG. 18 in an exploded view. For a preferred embodiment, each quadrant boundary line 66 may match a fabrication seam 22. This may provide for ease and uniformity of manufacturing by rendering each of the components of the cubical block unit 3 identical. For a preferred embodiment, the square connection faces 5 of magnetic block units 1 which have a non-cubular shaped block body 2 and which also have connection faces 5 with other geometrical shapes, such as the examples shown in FIGS. 13-15, may also have their connection face receivers 63 positioned and distributed as described above in order to provide for the square connection faces 5 of different shaped magnetic block units 1 to be connected with sides and corners aligned as shown in FIG. 18 in an exploded view.

Figure 19:
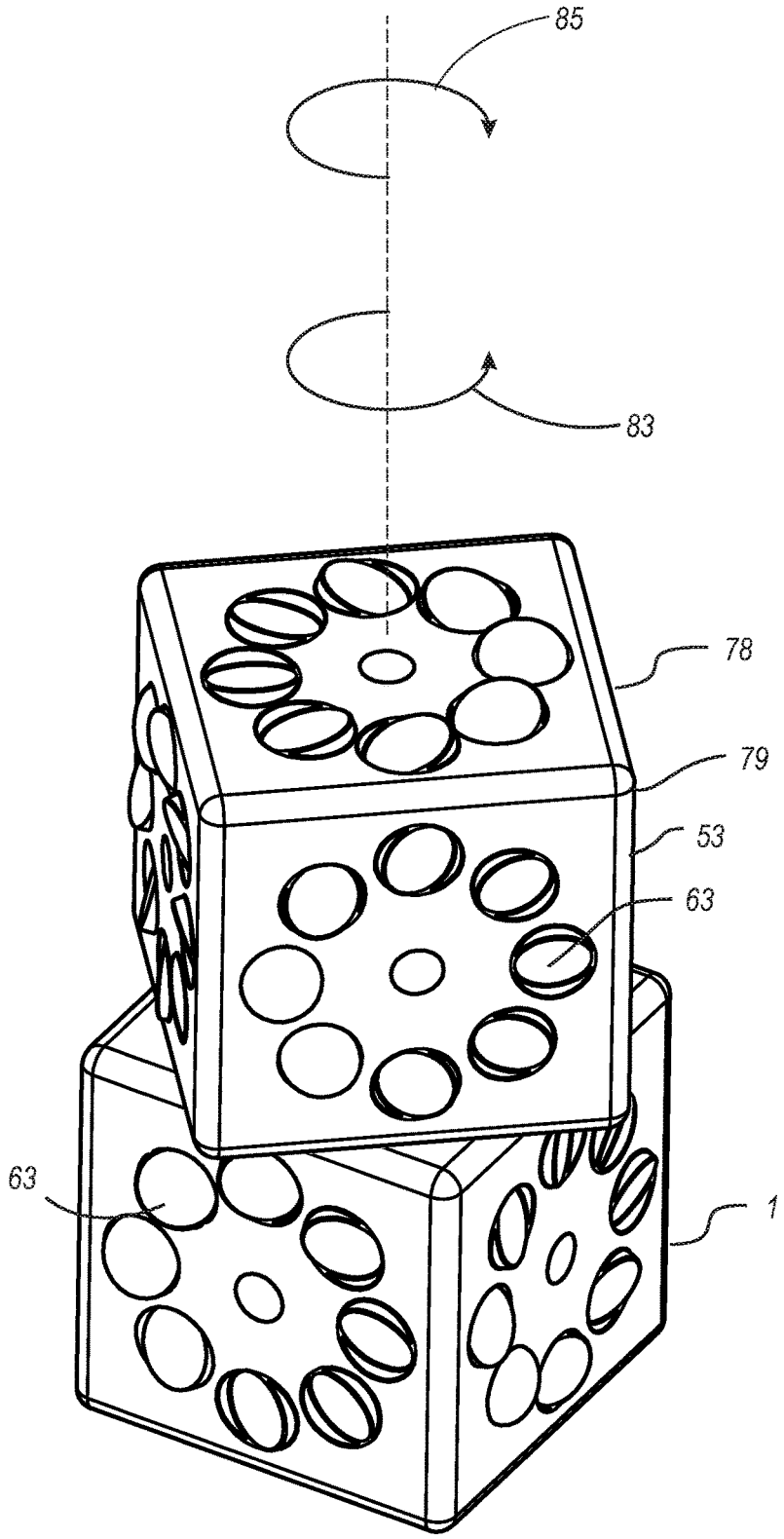
FIG. 19 is a perspective exploded view detail of the two connected and aligned magnetic block units, showing rotation of the connection faces with respect to each other.

Referring to FIG. 19 the structure of the connection face receivers 63 of this embodiment of the magnetic block unit 1 allows the rotational positioning 78 of one magnetic block unit 1 with respect to the other magnetic block unit 53 that it is connected to, providing for a variety of interconnection configurations 79 between connected magnetic block units 1 and 53. While the connected magnetic block units 1 and 53 may be rotated with respect to each other in the bias direction 83, generally without separating the magnetic block units 1 magnetically, the magnetic block units 1 will have to be separated in order to rotate in the counter bias direction 85. The block units 1, 53 can be easily rotated with respect to each other in the bias direction 83 but such rotation and repositioning will be resisted in the counter bias direction 85, requiring separation of the magnetic block units 1, 53.

Figure 12:
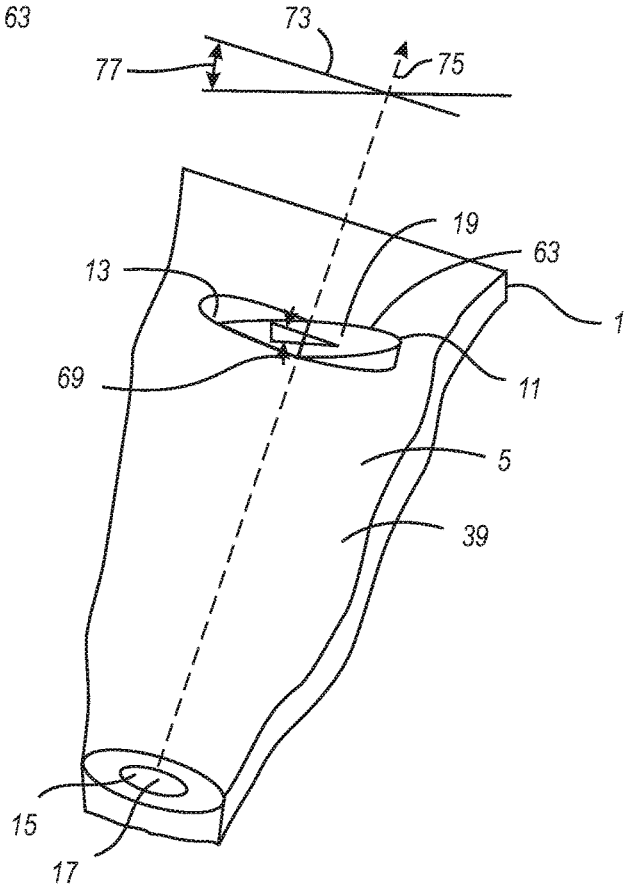
FIG. 12 is a perspective detail of the generally circular shaped receiver surface of a preferred surface feature configuration having a magnetic element chamber surface opening.

Referring now to FIG. 10, a plan view of a connection face of an alternative preferred embodiment of a magnetic block unit 1 having a square face showing an alternative preferred surface feature configuration 59 with a circular connection face receiver 63 comprised of a connection face protrusion 11, a connection face recess 13, and a circular receiver surface 19. Referring also to FIG. 12, a perspective detail is shown of a circular connection face receiver 63 for the embodiment of the magnetic block unit 1 shown in FIG. 10.

The shape of the receiver surface 19 could be essentially any geometric shape such as a square, rectangle, parallelogram, or oval. However the inventor has noted that the generally triangular shape of the connection face receiver 63 as shown in FIGS. 1, 9 and 11 is a preferred embodiment due to ease of alignment, mating, and rotational positioning of the magnetic block units 1 with respect to each other.

Figure 13:
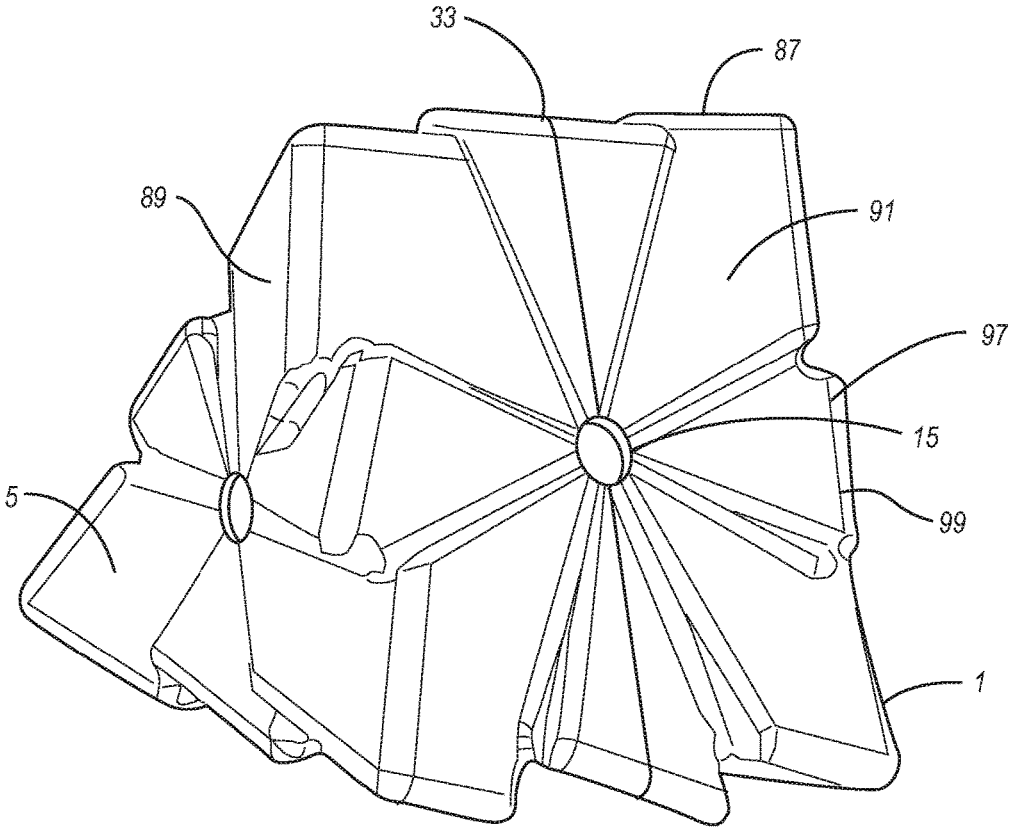
FIG. 13 is a perspective view of an equilateral triangular shaped magnetic block unit of the present invention having two connection faces with an equilateral triangle shape and three square shaped connection faces, each of the connection faces having a magnetic element chamber surface opening.

Referring now to FIG. 13, a perspective view of an equilateral triangle magnetic block unit 87 of the present invention having a block body 2 with two equilateral triangle shaped connection faces 89 and three square shape connection faces 91 is shown. This is a preferred additional embodiment of a magnetic block unit that would preferably be included in a magnetic block set of the present invention, because each of the connection faces 5 of this magnetic block unit 1 may have connection face receivers 63 of the same dimensions (to the extent of the truncation at the connection face edge 33), position, orientation, and distribution as the cubular magnetic block unit 3 shown in FIGS. 1 and 9. Each of the connection faces 5 of this equilateral triangle magnetic block unit 87 will readily mate with and connect to any of the connection faces 5 of cubular magnetic block unit 3 shown in FIGS. 1 and 9, as well as each of the connection faces 5 of the isosceles triangle magnetic block unit 95 of the present invention shown in FIG. 14, the rectangular solid magnetic block unit 97 of the present invention shown in FIG. 15, the triangular solid rectangular magnetic block unit 99 of the present invention shown in FIG. 16, and the triangular composite magnetic block unit 101 of the present invention shown in FIG. 17.

It should be noted that even if the connection face receiver perimeter 97 for a connection face 5 of a magnetic block unit 1 is truncated 100, as shown for the preferred embodiment of FIG. 13, the equilateral triangle shaped connection face 89 will still readily connect with and mate with the connection face of other magnetic block units 1 of the magnetic block set of the present invention.

Figure 15:
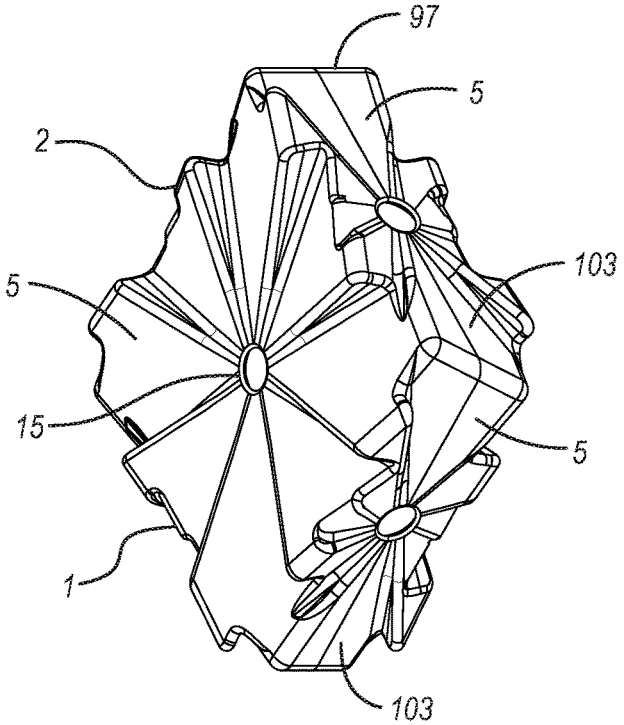
FIG. 15 is a perspective view of a rectangular solid magnetic block unit of the present invention having two square shaped connection faces and four rectangular shaped connection faces.

The same is true for the severely truncated connection faces 103 of the rectangular solid magnetic block unit 97 as shown in FIG. 15 as well as the severely truncated connection face 105 of the triangular solid magnetic block unit 99 shown in FIG. 16.

Figure 14:
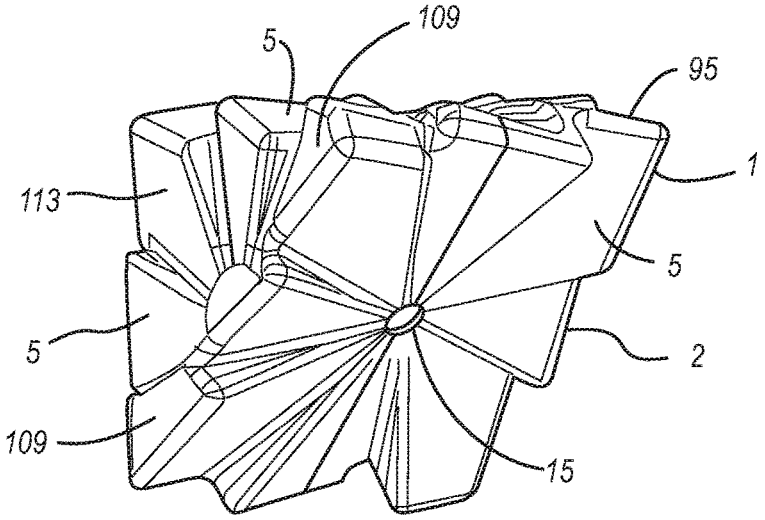
FIG. 14 is a perspective view of an isosceles triangular shaped magnetic block unit of the present invention having two isosceles triangular shaped connection faces, one square shaped connection face and two rectangular shaped connection faces, with each connection face having a magnetic element chamber surface opening.

Referring also to FIG. 14, even with the laterally truncated connection face receivers 109 of the isosceles triangle magnetic block unit 95 embodiment shown in FIG. 14, the isosceles triangle shaped faces 113 will mate with and connect with the connection faces 5 of the various other shapes and embodiments of the magnetic block units 1.

The equilateral triangle magnetic block unit 87 of FIG. 13, the isosceles triangle magnetic block unit 95 of FIG. 14, the rectangular solid magnetic block unit 97 of FIG. 15, the triangular solid magnetic block unit 99 of FIG. 16, and the triangular composite magnetic block unit 101 of FIG. 17 are merely examples of some of the variations of magnetic block units 1 of the magnetic block set of the present invention and therefore intended to be merely illustrative and not limiting of the many variations of magnetic block units 1 of the present invention that will be known to persons of skill in the art in view of the disclosures of the drawings and this specification. Other variations of the magnetic block unit 1 having block bodies 2 with other block body shapes and having connection faces 5 with other geometric shapes, such as rectangles, parallelograms, pentagons, hexagons, octagons, and trapezoids, will be known to persons of skill in the art in view of the disclosures of the drawings and this specification.

Similarly, a large variety of additional shapes other than the shapes commonly referred to as geometric shapes may be used for the connection faces 5. These may include a circular or generally circular shape, an oval shape, a flower petal shape, or virtually any ornamental shape that provides for the uniform dimensioning, positioning, orientation, and distribution of the connection face receivers 63, as well as the uniform receiver surface slant angle 69, for each of the connection surfaces 39. This may provide for the mating of such connection faces 5 with connection faces 5 of other block units 1 having the same or different shapes. This may also provide for the mating of a base of a figurine or other objects of play having a circular or other preferred shape of connection face 5 with a block unit 1.

The embodiments of the connection surfaces 39 shown in FIG. 1 and FIG. 2 are merely illustrative since, as discussed above as discussed herein, the shape of the receiver surface 19 may be generally triangular as shown in FIG. 1, circular as shown in FIG. 2 or may incorporate a number of other geometric shapes so long as the connection face receivers are uniformly sized (to the extent limited by truncations), positioned, oriented and distributed with respect to the magnetic element chamber center 17, they will provide for the mating of respective connection faces of connected magnetic block units 1.

It will be noted that for the embodiments of the magnetic block units 1 shown in FIG. 1 and FIG. 2 respectively, and the further related drawings, each of the embodiments is illustrated with eight connection face receivers 63 on each connection face 5. For preferred embodiments, the number of connection face receivers 63 may be any even number. A smaller number of connection face receivers 63 results in a more limited capability of relative rotation of one magnetic block unit on the other, and a larger number, which results in the smaller size of the connection face receivers 63, may increase manufacturing difficulty. Odd numbers of connection face receivers 63 may be used, but the reflected connection face features will not match such as to allow an alignment of the sides and corners of the mated magnetic block units 1 and 53 as illustrated in FIG. 18. An odd number of connection face receivers 63 would require a misalignment or a rotation of one magnetic block unit with respect to the other in order for the connection face receivers to connect and mate.

Figure 20:
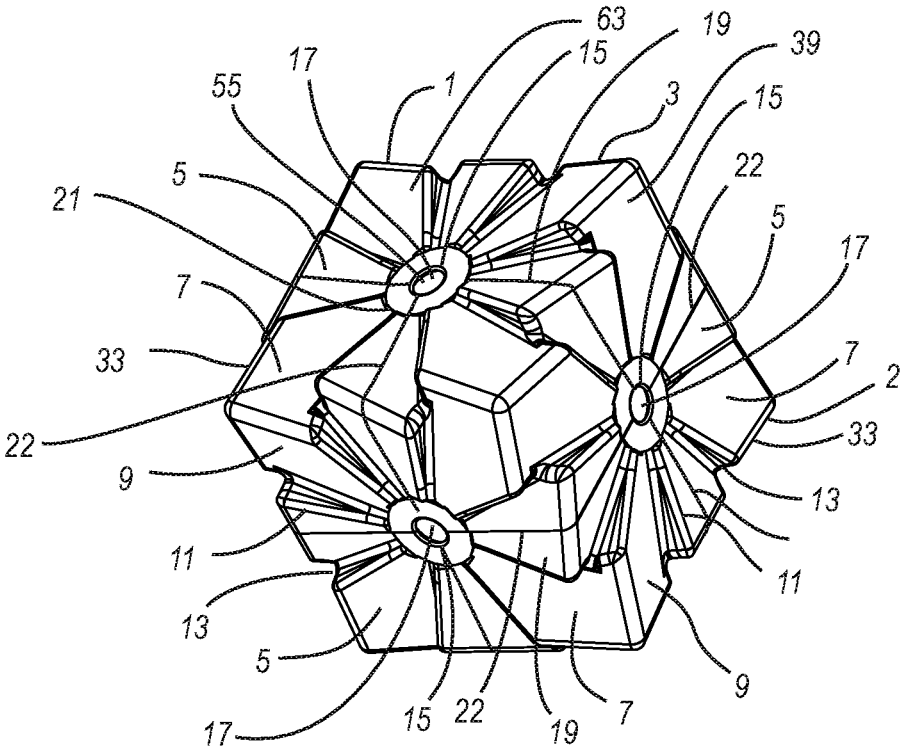
FIG. 20 is a perspective view of an alternative magnetic block unit of the magnetic block set of the present invention illustrating an alternative surface feature configuration with the connection faces having a magnetic element zone adjacent to the magnetic element chamber surface opening with the connection face protrusions extending from a magnetic element zone to the connection face edge.

Referring now to FIG. 20, alternative embodiments of the magnetic block unit 1 may have connection faces 5 having connection face surface features 9 which include a magnetic element zone 21 positioned around the magnetic element chamber opening 15, for the embodiments having a magnetic element chamber opening 15, or positioned around the magnetic element chamber center 17, for those alternative embodiments having a sealed magnetic element chamber 16. For those alternative embodiments, the connection face receivers 63, including the connection face protrusions 11, the connection face recesses 13, and the receiver surfaces 19, may extend from the magnetic element zone 21 to the respective connection face edges 33.

In view of the disclosures of this specification and the drawings, other embodiments and other variations and modifications of the embodiments described above will be obvious to a person skilled in the art. Therefore, the foregoing is intended to be merely illustrative of the invention and the invention is limited only by the following claims and the doctrine of equivalents.

What is claimed is:

1. A magnetic block set comprising a plurality of magnetically connectable magnetic block units, a plurality of the magnetic block units comprising:

a block body having one or more connection faces, each connection face having a plurality of connection face edges and a connection face surface;

one or more magnetic element chambers in the block body, each magnetic element chamber being positioned proximal to a connection face and having a magnetic element chamber surface opening in the connection face, the magnetic element chamber surface opening having a magnetic element chamber center;

one or more magnetic elements, each magnetic element being rotatably retained in a respective magnetic element chamber;

a plurality of connection face receivers in each connection face, each connection face receiver comprising a connection face protrusion, a connection face recess, and a receiver surface connecting the connection face protrusion and the connection face recess, each receiver surface being generally planar and having, between the connection face surface of the connection face and the receiver surface, a uniform receiver surface slant angle about a connection face radial axis extending from the magnetic element chamber center, the connection face receivers being uniformly positioned and uniformly oriented radially from the magnetic element chamber center and uniformly distributed circularly with respect to the magnetic element chamber center of the magnetic element chamber, each connection face receiver being uniformly dimensioned and uniformly shaped radially with respect to the magnetic element chamber center except to an extent that the connection face receiver may be truncated at a connection face edge of the connection face, the connection face receivers providing for a rotational positioning of the connection face of the magnetic block unit with respect to a connection face of a second magnetic block unit of the magnetic block set that is mated with the connection face of the magnetic block unit, providing for a plurality of interconnection configurations between the magnetic block unit and the second magnetic block unit, and providing for the magnetic block unit to be rotated with respect to the second magnetic block unit in a bias direction without separating the magnetic block unit from the second block unit magnetically.

2. The magnetic block set recited in claim 1 wherein the one or more connection faces of a plurality of the block units have a geometric shape.

3. The magnetic block set recited in claim 1 wherein one or more of the one or more connection faces of a plurality of the block units have an ornamental shape.

4. The magnetic block set recited in claim 1 wherein one or more of the one or more connection faces have four face quadrants connected at quadrant boundary lines which extend from the magnetic element chamber center, each of these connection faces has an even number of connection face receivers, and the connection face receivers of each of these connection faces are uniformly positioned and distributed within each face quadrant with each quadrant boundary line being aligned with a receiver radial center line extending from the magnetic element chamber center.

5. The magnetic block set recited in claim 1 wherein each connection face has a connection surface and a respective shape which provides for a uniform dimensioning, positioning, orientation, and distribution of the connection face receivers, and a uniform receiver surface slant angle, for each of the connection surfaces.

6. The magnetic block set recited in claim 1 wherein the magnetic element and the magnetic element chambers have a spherical shape.

7. The magnetic block set recited in claim 1 wherein the magnetic element and the magnetic element chambers have a spherical shape, the magnetic element has a magnetic element diameter, the magnetic element chamber has a magnetic element chamber diameter, and there is a magnetic element clearance between the magnetic element diameter and the magnetic element chamber diameter.

8. The magnetic block set recited in claim 1 wherein the connection face receivers have a triangular shape.

9. The magnetic block set recited in claim 1 wherein the connection face receivers have a circular shape.

10. The magnetic block set recited in claim 1 wherein the connection face receivers have a geometric shape.

11. A magnetic block set comprising a plurality of magnetically connectable magnetic block units, a plurality of the magnetic block units comprising:

a block body having one or more connection faces, each connection face having a plurality of connection face edges and a connection face surface;

one or more magnetic element chambers in the block body, each magnetic element chamber being positioned proximal to a connection face, and having a magnetic element chamber center;

one or more magnetic elements, each magnetic element being rotatably retained in a respective magnetic element chamber;

a plurality of connection face receivers in each connection face, each connection face receiver comprising a connection face protrusion, a connection face recess, and a receiver surface connecting the connection face protrusion and the connection face recess, each receiver surface being generally planar and having, between the connection face surface of the connection face and the receiver surface, a uniform receiver surface slant angle about a connection face radial axis extending from the magnetic element chamber center, the connection face receivers being uniformly positioned and uniformly oriented radially from the magnetic element chamber center and uniformly distributed circularly with respect to the magnetic element chamber center of the magnetic element chamber, each connection face receiver being uniformly dimensioned and uniformly shaped radially with respect to the magnetic element chamber center except to an extent that the connection face receiver may be truncated at a connection face edge of the connection face, the connection face receivers providing for a rotational positioning of the connection face of the magnetic block unit with respect to a connection face of a second magnetic block unit of the magnetic block set that is mated with the connection face of the magnetic block unit, providing for a plurality of interconnection configurations between the magnetic block unit and the second magnetic block unit, and providing for the magnetic block unit to be rotated with respect to the second magnetic block unit in a bias direction without separating the magnetic block unit from the second block unit magnetically.

12. The magnetic block set recited in claim 11 wherein the one or more connection faces of a plurality of the block units have a geometric shape.

13. The magnetic block set recited in claim 11 wherein one or more of the one or more connection faces of a plurality of the block units have an ornamental shape.

14. The magnetic block set recited in claim 11 wherein one or more of the one or more connection faces have four face quadrants connected at quadrant boundary lines which extend from the magnetic element chamber center, each of these connection faces has an even number of connection face receivers, and the connection face receivers of each of these connection faces are uniformly positioned and distributed within each face quadrant with each quadrant boundary line being aligned with a receiver radial center line extending from the magnetic element chamber center.

15. The magnetic block set recited in claim 11 wherein each connection face has a connection surface and a respective shape which provides for a uniform dimensioning, positioning, orientation, and distribution of the connection face receivers, and a uniform receiver surface slant angle, for each of the connection surfaces.

16. The magnetic block set recited in claim 11 wherein the magnetic element and the magnetic element chambers have a spherical shape.

17. The magnetic block set recited in claim 11 wherein the magnetic element and the magnetic element chambers have a spherical shape, the magnetic element has a magnetic element diameter, the magnetic element chamber has a magnetic element chamber diameter, and there is a magnetic element clearance between the magnetic element diameter and the magnetic element chamber diameter.

18. The magnetic block set recited in claim 11 wherein the connection face receivers have a triangular shape.

19. The magnetic block set recited in claim 11 wherein the connection face receivers have a circular shape.

20. The magnetic block set recited in claim 11 wherein the connection face receivers have a geometric shape.

21. A magnetic block set comprising a plurality of magnetically connectable magnetic block units, a plurality of the magnetic block units comprising:

a block body having a plurality of connection faces, each connection face having a plurality of connection face edges and a connection face surface;

a plurality of magnetic element chambers in the block body, each magnetic element chamber being positioned proximal to a connection face, the magnetic element chamber having a magnetic element chamber center;

a plurality of magnetic elements, each magnetic element being rotatably retained in a respective magnetic element chamber;

a plurality of connection face receivers in each connection face, each connection face receiver comprising a connection face protrusion, a connection face recess, and a receiver surface connecting the connection face protrusion and the connection face recess, each receiver surface being generally planar and having, between the connection face surface of the connection face and the receiver surface, a uniform receiver surface slant angle about a connection face radial axis extending from the magnetic element chamber center, the connection face receivers being uniformly positioned and uniformly oriented radially from the magnetic element chamber center and uniformly distributed circularly with respect to the magnetic element chamber center of the magnetic element chamber, each connection face receiver being uniformly dimensioned and uniformly shaped radially with respect to the magnetic element chamber center except to an extent that the connection face receiver may be truncated at a connection face edge of the connection face, the connection face receivers providing for a rotational positioning of the connection face of the magnetic block unit with respect to a connection face of a second magnetic block unit of the magnetic block set that is mated with the connection face of the magnetic block unit, providing for a plurality of interconnection configurations between the magnetic block unit and the second magnetic block unit, and providing for the magnetic block unit to be rotated with respect to the second magnetic block unit in a bias direction without separating the magnetic block unit from the second block unit magnetically.

22. A magnetic block set comprising a plurality of magnetically connectable magnetic block units, a plurality of the magnetic block units comprising:

a block body having a plurality of connection faces, each connection face having a plurality of connection face edges and a connection face surface and one or more of the connection faces having four face quadrants connected at quadrant boundary lines which extend from the magnetic element chamber center;

a plurality of magnetic element chambers in the block body, each magnetic element chamber being positioned proximal to a connection face and having a magnetic element chamber surface opening in the connection face, the magnetic element chamber surface opening having a magnetic element chamber center;

a plurality of magnetic elements, each magnetic element being rotatably retained in a respective magnetic element chamber;

a plurality of connection face receivers in each of the connection faces, each connection face receiver comprising a connection face protrusion, a connection face recess, and a receiver surface connecting the connection face protrusion and the connection face recess, each receiver surface being generally planar and having, between the connection face surface of the connection face and the receiver surface, a uniform receiver surface slant angle about a connection face radial axis extending from the magnetic element chamber center, the connection face receivers being uniformly positioned and uniformly oriented radially from the magnetic element chamber center and uniformly distributed circularly with respect to the magnetic element chamber center of the magnetic element chamber, each connection face receiver being uniformly dimensioned and uniformly shaped radially with respect to the magnetic element chamber center except to an extent that the connection face receiver may be truncated at a connection face edge of the connection face, each of the one or more of the connection faces having four face quadrants connected at quadrant boundary lines which extend from the magnetic element chamber center having an even number of connection face receivers, the connection face receivers providing for a rotational positioning of the connection face of the magnetic block unit with respect to a connection face of a second magnetic block unit of the magnetic block set that is mated with the connection face of the magnetic block unit, providing for a plurality of interconnection configurations between the magnetic block unit and the second magnetic block unit, and providing for the magnetic block unit to be rotated with respect to the second magnetic block unit in a bias direction without separating the magnetic block unit from the second block unit magnetically.

* * * * *